United States Patent [19]

Okamoto et al.

[11] 4,049,683

[45] Sept. 20, 1977

[54] METHOD OF PREPARING LABELLED VEGETABLE OIL

[75] Inventors: Hiroyuki Okamoto, Akashi; Yoshio Tsuda, Kyoto; Kazumasa Yokoyama, Suita, all of Japan

[73] Assignee: The Green Cross Corporation, Osaka, Japan

[21] Appl. No.: 583,293

[22] Filed: June 3, 1975

[30] Foreign Application Priority Data

Nov. 6, 1974 Japan ..... 49-127701

[51] Int. Cl.[2] ..... C11C 3/10

[52] U.S. Cl. ..... 260/410.7; 424/1

[58] Field of Search ..... 260/398, 410.7; 424/1

[56] References Cited

FOREIGN PATENT DOCUMENTS 701,423 1/1965 Canada ..... 424/1

OTHER PUBLICATIONS

Mangold et al., J. Biol. Chem., vol. 229, Nov.-Dec. 1957, pp. 731 to 741.

Glascock et al., Biochem. J., vol. 98, 1966, pp. 149 to 156.

Jones et al., J. Am. Chem. Soc., vol. 78, pp. 2498 to 2499, (1956).

Bergstrom et al., ACTA Physiol. Scand., vol. 25, pp. 120 to 124, (1952).

*Primary Examiner*—Leland A. Sebastian

*Attorney, Agent, or Firm*—Cushman, Darby & Cushman

[57] ABSTRACT

A method for preparing a vegetable oil labelled with $^{14}C$ or $^{3}H$, characterized by transesterifying a vegetable oil with at least one of the chemically same fatty acids labelled with $^{14}C$ or $^{3}H$ as those constituting said vegetable oil. The resulting labelled vegetable oil can be used in measuring biological metabolic activity of man or an animal or as a biological tracer reagent.

10 Claims, No Drawings

METHOD OF PREPARING LABELLED VEGETABLE OIL

This invention relates to a natural triglyceride labelled with $^{14}C$ or $^{3}H$. More particularly it relates to a triglyceride containing a $^{14}C$- or $^{3}H$-labelled fatty acid constituent as the acid radical and which is indistinguishable from a natural vegetable oil in composition, and in chemical and physiological properties, and to a method for preparing same.

As is well known, vegetable oils are used in various fields including foods, soaps, paints, drugs, lubricating oils, etc. In these use fields, vegetable oils labelled with radioisotopes are strongly demanded as tracer reagents. For example, labelled vegetable oils such as labelled soybean oil, sesame oil, peanut oil, etc., are attracting special attention as a reagent for measuring the biological metabolic activity of man as well as animals or as a biological tracer reagent.

Synthetic simple triglycerides containing $^{14}C$- or $^{3}H$-labelled fatty acids, such as labelled tripalmitic acid glyceride and labelled trioleic acid glyceride have already been available commercially. These simple triglycerides, however, are entirely different from vegetable oils which are natural glycerides in composition as well as in biochemical behavior, and it might be said that they shall find but limited uses.

An object of this invention is to provide a novel natural triglyceride containing $^{14}C$- or $^{3}H$-labelled fatty acids (hereinafter referred to as labelled vegetable oil), which is indistinguishable from the vegetable oil in composition as well as in chemical and biochemical properties, and an industrially advantageous method for preparing same.

Other objects and advantages of this invention will become apparent from the following description.

According to this invention, a $^{14}C$- or $^{3}H$-labelled vegetable oil can be prepared by subjecting a vegetable oil to the transesterification with at least one fatty acid labelled with $^{14}C$ or $^{3}H$, said fatty acid having been selected from the fatty acids constituting said vegetable oil.

The vegetable oil for use in the present invention can be a drying, semi-drying, or a nondrying oil. Examples include linseed oil, perilla oil, tung oil, sesame oil, rapessed oil, cotton seed oil, soybean oil, tsubaki oil, olive oil, and castor oil. Preferred oils are those which have been purified (in compliance with Japanese Agriculture and Forestry Standard: Fats and Oils (cf. Notification No. 554 of the Ministry of Agriculture and Forestry); Chemical Mannual of Fats and Oils ("Yushi Kagaku Benran", p 145–431)) to remove impurities such as unsaponifiable matters, volatile acids, and the like.

The $^{14}C$- or $^{3}H$-labelled fatty acid to be used can be any irrespective of the type of vegetable oil from which it has been derived or of the number of carbon atoms and the degree of unsaturation so long as it is one of the fatty acids constituting the vegetable oil to be labelled. The labelled fatty acid is selected preferably from those contained in the vegetable oil to be transesterified. In view of the ease of availability, recommendable fatty acids are linolenic acid-1-$^{14}C$, palmitic acid-1-$^{14}C$, palmitic acid-9,10-$^{3}H$, linolic acid-1-$^{14}C$, oleic acid-1-$^{14}C$, oleic acid-9,10-$^{3}H$, and, in some cases, mixtures of these.

The transesterification in the present method is carried out by heating a mixture of the vegetable oil and the labelled fatty acid under the an aerobic condition. A suitable reactant ratio is in the range from 100 to 10,000 moles of the vegetable oil to one mole of the fatty acid, the most preferred molar ratio being 1,000 to 1. The reaction is carried out under an atmosphere of an inert gas such as nitrogen, argon, helium, or a mixture of two or more of these to avoid the oxidation or degradation of the fatty acid. No catalyst is particularly required. A suitable reaction temperature is 270° to 290° C., in the absence of a catalyst. A sufficient reaction time is 30 minutes to one hour. A reaction time exceeding one hour increases the conversion so slightly that no real benefit will be resulted.

After completion of the reaction, the reaction mixture is cooled and the resultant labelled vegetable oil is separated for recovery from the reaction mixture. The recovery is carried out in a generally known way for separating vegetable oils from fatty acids (Chemical Manual of Fats and Oils ("Yushi Kagaku Benran", p 393–403, 1958)). A technique of column chromatography is especially suitable. The packing materials preferred for use are those adsorbents containing silicic acid as main constituent, such as, for example, silica gel and a co-precipitate of magnesia and silica ("Florisil" of Floridin Co.). When silica gel is used, the loaded column is first washed with petroleum ether and then developed and eluated with mixtures of petroleum ether and ethyl ether, the ratio of which is varied stepwise from 100:0 to 95:5. In the case of a Florisil column, the loaded column was treated with mixtures of hexane and ethyl ether, the ratio of which is varied stepwise from 100:0 to 85:15. A purified labelled vegetable oil is obtained by collecting the fraction which has been confirmed as containing the vegetable oil. The eluate of the vegetable oil is collected and evaporated to dryness under nitrogen. The labelled vegetable oil prepared by the present invention is indistinguishable from the original one chemically, physicochemically and biochemically, so that it is used for various purposes as a radiochemicals. The present invention is believed to be of significance in providing a method for preparing such a novel labelled compound conveniently and at low cost.

The invention is illustrated below in further detail with reference to Examples, but the invention is not limited thereto.

In Examples the radioactivity was measured by means of a liquid scintillation spectrometer made by Pachard Co. and the specific activity is expressed in terms of $\mu$ Ci/millimole.

EXAMPLE 1

In a 5-ml glass ampule, was introduced 1 ml (about 1.06 mmole) of purified soybean oil, followed by 25 $\mu$ Ci in terms of radioactivity (110 $\mu$g; 0.431 $\mu$mole) of palmitic acid-1-$^{14}C$ (specific activity: 58 m Ci/mmole) and mixed. After the air in the ampule had been replaced thoroughly with nitrogen, the ampule was sealed off. The sealed ampule was heated at 280° C in an oil bath for 1 hour to allow the reaction to proceed. After having been cooled to room temperature, the ampule was opened and all of the reaction solution was poured over a column (2.5 cm $\times$ 27 cm) of silica gel (silica gel No. II-a for chromatography made by Merck Co.) to allow the solution to be adsorbed on the column. After 200 ml of petroleum ether was passed down the column, the adsorbate was developed by passing 200 ml of 99:1 mixture of petroleum ether and ethyl ether and then the developed labelled soybean oil was eluated by passing 1000 ml of 96:4 mixture of petroleum ether and ethyl ther to obtain 1 liter of the eluate fraction containing abelled vegetable oil.

The said fraction was freed from the solvent by distilation under a nitrogen stream at atmospheric pressure o obtain 0.93 ml of the purified $^{14}C$-labelled soybean oil having a radioactivity of 20.5 $\mu$ Ci. From the radioactivity, it was found that the degree of exchange of fatty acid was 82% and the specific activity of the transesterified soybean oil was 17.9 $\mu$ Ci/mmole.

Chemical properties and composition of the thus obtained $^{14}C$-labelled soybean oil as compared with those of soybean oil used as starting material are as shown in Table 1.

Table 1

| | Labelled soybean oil | | Soybean oil (starting material) |
|---|---|---|---|
| Saponification value | 189.5 | | 188.4 |
| Iodine value | 123.7 | | 132.6 |
| Fatty acid composition (%) | Palmitic acid | 15.2 | 14.9 |
| | Stearic acid | 4.1 | 3.7 |
| | Oleic acid | 25.9 | 24.7 |
| | Linolic acid | 47.6 | 49.1 |
| | Linolenic acid | 7.2 | 7.6 |
| Distribution ratio between $\alpha$ and $\beta$ positions of glycerol where palmitic acid is attached | By $^{14}C$ measurement. $\alpha : \beta = 9.5 : 1$ | | By chemical analysis of natural product $\alpha : \beta = 10 : 1$ |

It is apparent from the results shown in Table 1 that the $^{14}C$-labelled soybean oil has not so much changed as s distinguishable in chemical properties from the soybean oil used as starting material and, accordingly, can be called a labelled soybean oil.

EXAMPLE 2

In a 5-ml glass ampule, was introduced 1 ml (about 1.06 mmole) of purified soybean oil, followed by 125 $\mu$ Ci in terms of radioactivity (128 $\mu$g; 0.5 $\mu$mole) of palmitic acid-9,10-$^{3}H$ (specific activity: 250 ml Ci/mmole) and mixed. After the air in the ampule had been replaced thoroughly with nitrogen, the ampule was sealed off. The sealed ampule was heated in an oil bath maintained at 280° C. for 1 hour to allow the reaction to proceed. After having been cooled to room temperature, the ampule was opened and all of the reaction solution was poured over a column (2.5 cm × 27 cm) of Florisil (made by Floridin Co.) to allow the solution to be adsorbed on the column. After 200 ml of hexane was passed down the column, the adsorbate was developed by passing 200 ml of 99:1 mixture of hexane and ethyl ether and then the developed labelled soybean oil was eluated by passing 1000 ml of 85:15 mixture of hexane and ethyl ether to obtain 1 liter of a fraction containing the labelled soybean oil. The fraction was freed from the solvent by distillation under a nitrogen atmosphere to obtain 0.91 ml of the purified $^{3}H$-labelled soybean oil having a radioactivity of 98.1 $\mu$ Ci. From the radioactivity value, it was found that the degree of ester exchange was 78.5% and the specific activity was 87.5 $\mu$ Ci/mmole.

The chemical properties and composition of the $^{3}H$-labelled soybean oil were compared with those of the soybean oil used as starting material and the results similar to those shown in Table 1 were obtained. Consequently, it is obvious that the $^{3}H$-labelled soybean oil has not so much changed as is distinguishable in chemical properties from the soybean oil used as starting material and can be called a labelled soybean oil.

EXAMPLE 3

In a 5-ml glass ampule, was place 1 ml (about 1.1 mmole) of purified linseed oil, followed by 25 $\mu$ Ci in terms of radioactivity (125 $\mu$g; 0.446 $\mu$mole) of linolic acid-1-$^{14}C$ (specific activity: 57 m Ci/mmole) and mixed. After the air in the ampule had been thoroughly replaced with nitrogen, the ampule was sealed off. The sealed ampule was heated in an oil bath maintained at 270° C. for 30 minutes to allow the reaction to proceed. After having been cooled to room temperature, the ampule was opened and the whole reaction solution was poured over the same silica gel column as used in Example 1. The loaded column was treated in the same manner as in Example 1 to obtain 1 liter of a fraction containing the labelled linseed oil. The fraction was freed from the eluent by distillation under a nitrogen atmosphere to obtain 0.90 ml of the purified $^{14}C$-labelled linseed oil having a radioactivity of 17.8 $\mu$Ci. From the radioactivity value, it was found by calculation that the degree of ester exchange was about 71% and the specific activity was 15.4 $\mu$Ci/mmole. Chemical properties of the $^{14}C$-labelled linseed oil and those of the linseed oil used as starting material were as shown in Table 2.

Table 2

| | Labelled linseed oil | | Linseed oil (starting material) |
|---|---|---|---|
| Saponification value | 190 | | 191 |
| Iodine value | 180 | | 185 |
| Fatty acid composition (%) | Palmitic acid | 6.9 | 6.1 |
| | Stearic acid | 3.8 | 3.2 |
| | Palmitoleic acid | 0.6 | 0.1 |
| | Oleic acid | 17.3 | 16.6 |
| | Linolic acid | 14.0 | 14.2 |
| | Linolenic acid | 57.4 | 59.8 |
| Distribution ratio of palmitic acid between $\alpha$ and $\beta$ positions of glycerol | By $^{14}C$ measurement. $\alpha : \ominus = 24 : 1$ | | By chemical analysis of natural product. $\alpha : \ominus = 25 : 1$ |

According to the results shown in Table 2, there is scarcely any difference in chemical properties between the $^{14}C$-labelled linseed oil and the linseed oil used as starting material and, accordingly, it can be said that the linseed oil has been labelled without any chemical change.

What is claimed is:

1. A method for preparing a labelled oil comprising transesterifying a vegetable oil in the presence of an inert gas at a reaction temperature of 260° to 320° C. for 30 to 60 minutes with at least one of the chemically-same fatty acids labelled with $^{14}C$ or $^{3}H$ as those constituting said vegetable oil, and recovering the labelled oil which is formed, the molar ratio of the labelled fatty acid to the vegetable oil being from 1:100 to 1:10,000.

2. A method according to claim 1, wherein the vegetable oil is linseed oil, perilla oil, tung oil, sesame oil, rapeseed oil, cotton seed oil, soybean oil, tsubaki oil, olive oil, or castor oil.

3. A method according to claim 1, wherein the fatty acid labelled with $^{14}C$ or $^{3}H$ is linolenic.

4. A method according to claim 1, wherein molar ratio of the labelled fatty acid to the vegetable oil is from 1:100 to 1:10,000.

5. A method according to claim 1, wherein the inert gas is nitrogen, argon, helium, or a mixture of two or more of these gases.

6. A method according to claim 1, wherein recovery of the labelled vegetable oil is performed by column chromatography.

7. A method according to claim 6, wherein in the column chromatography, are used silica gel as the packing material and a mixture of petroleum ether and ethyl ether in a volume ratio ranging from 100:0 to 95:5 as the developing solvent.

8. A method according to claim 6, wherein in the column chromatography, are used a co-precipitated mixture of magnesia and silica as the packing material and a mixture of hexane and ethyl ether in a volume ratio ranging from 100:0 to 85:15 as the developing solvent.

9. A method according to claim 1 wherein the fatty acids are labelled with $^{14}C$.

10. A method according to claim 1 wherein the transesterification is carried out at 270° to 290° C.

* * * * *